US006315842B1

(12) United States Patent
Shahani et al.

(10) Patent No.: US 6,315,842 B1
(45) **Date of Patent: *Nov. 13, 2001**

(54) THICK ALZNMGCU ALLOY PRODUCTS WITH IMPROVED PROPERTIES

(75) Inventors: Ravi Shahani, Moirans; Jean-Francois Verdier, Issoire; Phlilippe Lassince, Issoire; Guy-Michel Raynaud, Issoire; Christophe Sigli; Pierre Sainfort, both of Grenoble, all of (FR)

(73) Assignee: Pechiney Rhenalu, Courbevoie (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/487,298

(22) Filed: Jan. 19, 2000

Related U.S. Application Data

(63) Continuation of application No. 08/897,832, filed on Jul. 21, 1997, now Pat. No. 6,027,582, which is a continuation-in-part of application No. 08/836,473, filed on Aug. 25, 1997, now abandoned.

(51) Int. Cl.[7] ..... C22C 21/10
(52) U.S. Cl. ..... 148/417; 420/532; 420/541
(58) Field of Search ..... 420/532, 541; 148/417, 434

(56) References Cited

U.S. PATENT DOCUMENTS 3,881,966 * 5/1975 Staley et al. ..... 148/417
4,828,631 * 5/1989 Ponchel et al. ..... 148/417
5,221,377 * 6/1993 Hunt et al. ..... 420/532
5,865,911 * 2/1999 Miyasoto et al. ..... 148/439
6,027,582 * 2/2000 Shahani et al. ..... 420/541

OTHER PUBLICATIONS

ASM Handbook, vol. 4, Heat Treating, p. 847, ASM, 1991.*

* cited by examiner

*Primary Examiner*—George Wyszomierski
(74) *Attorney, Agent, or Firm*—Dennison, Scheiner, Schultz & Wakeman

(57) ABSTRACT

A mold for plastics made of a rolled, extruded or forged AlZnMgCu aluminum alloy product >60 mm thick, and having a composition including, in weight %:

| | |
|---|---|
| 5.7 < | Zn < 8.7 |
| 1.7 < | Mg < 2.5 |
| 1.2 < | Cu < 2.2 |
| | Fe < 0.14 |
| | Si < 0.11 |
| 0.05 < | Zr < 0.15 |
| | Mn < 0.02 |
| | Cr < 0.02 |

with Cu+Mg<4.1 and Mg>Cu, other elements<0.05 each and<0.10 in total, the product being treated by solution heat treating, quenching and aging to a T6 temper.

5 Claims, 2 Drawing Sheets

THICK ALZNMGCU ALLOY PRODUCTS WITH IMPROVED PROPERTIES

This application is a continuation of U.S. application Ser. No. 08/897,832 filed Jul. 21, 1997, now U.S. Pat. No. 6,027,582, which is a continuation-in-part of U.S. application Ser. No. 08/836,473 filed Aug. 25, 1997, abandoned.

FIELD OF THE INVENTION

The invention relates to products made from an aluminum alloy of the AlZnMgCu type (the 7000 series according to the Aluminum Association designation) with thicknesses greater than 60 mm. These products can be hot-rolled plates or sheets, forged blocks or extruded products. In cases where the product does not have a parallelepipedic shape, the term thickness refers to the smallest dimension of the product at the time of quenching (for example, the thickness of the thinnest wall for a section).

DESCRIPTION OF RELATED ART

Thick rolled, forged or extruded products made of aluminum alloys from the 7000 series are used to mass produce—by cutting, surfacing or machining—high strength pieces for the aeronautics industry, for example wing elements such as wing spars or fish plates, and fuselage elements such as frames, or mechanical engineering pieces like machine-tool components or molds for plastics.

These pieces must have a set of properties that are frequently antithetical to one another, requiring difficult compromises in the precise definition of the chemical composition and in the transformation range of the products used.

In effect, in the heat treated state, the products must simultaneously have:

- high mechanical strength in order to limit the weight of metal used,
- sufficient toughness to reduce the crack propagation rate,
- good fatigue resistance due to their use in structures subject to vibrations or stresses which are not constant over time,
- sufficient stress corrosion resistance.

Moreover, the alloy must be able to be cast and transformed under proper conditions so as to obtain acceptable metallurgical quality. The transformation which follows the casting of the plate or billet usually comprises a homogenization, a hot transformation by rolling, forging or extrusion, a natural aging, a quenching (for example by immersion in or spraying with a quenching liquid), a possible de-stressing by cold traction or compression, a natural aging and an artificial aging.

The cooling during the quenching can be more or less rapid. What is meant here by the quench rate is the average cooling speed (in ° C./s) of the product from 450° to 280° C. at quarter thickness. A product is said to be quench sensitive if its static mechanical properties, such as its yield strength, decrease when the quench rate decreases, which naturally has a greater chance of occurring in thick products.

In order to obtain high mechanical strength, as well as good toughness, a fibrous structure is generally sought, which is obtained by avoiding too great a recrystallization of the alloy. For this purpose, one or more elements called "antirecrystallants" such as Zr, Ti, Cr, Mn, V Hf, or Sc are added to the composition. Thus, the compositions registered with the Aluminum Association for the alloys 7010 and 7050 comprise an addition of Zr at contents from 0.10 to 0.16%, and from 0.08 to 0.15%, respectively.

This is clearly illustrated by the recent article by DORWARD et al., "Grain Structure and Quench-Rate Effects on Strength and Toughness of AA7050 AlZnMgCuZr Alloy Plate", Metallurgical and Materials Transactions A, Vol. 26A, pp. 2481–2484, which indicates, for example for 7050, a Zr+Ti content of 0.14%, and shows the effect, for 14-mm thick plates produced in the laboratory and not de-stressed, of extreme variations in the recrystallization rate between 15 to 80% on the yield strength of plates in the T6 temper. It also shows the effect on the quench sensitivity of 7050 of a quench rate of less than 20° C./s, which corresponds to the quench rate of products with thicknesses greater than about 50 mm.

However, these laboratory experiences are different from industrial practice, since the final thickness of 14 mm is obtained by a tepid-rolling which results in a relatively refined microstructure that is quite different from the microstructures that normally characterize thick plates obtained by hot rolling.

According to the DORWARD article, the effect of the recrystallization rate on L-T toughness diminishes with the quench rate. By way of example, FIG. 6 in the article by DORWARD et al. shows that for a quench rate of 8° C./s (which corresponds to a half-thickness of about 100 mm, characteristic of a heavy plate for the application considered), the L-T toughness is the same for a recrystallization rate of 15% or 50%, and is reduced by about 10% when the recrystallization rate goes up to 90%.

The addition of antirecrystallant elements, which would make it possible to limit the recrystallization, has the distinct disadvantage of reducing the ability of the product to harden after quenching and annealing, especially when it is thicker, since it hardens less at the core than on the surface, resulting in significant differences in the mechanical properties.

Thus, the article by M. CONSERVA and P. FIORINI, "Interpretation of Quench Sensitivity in AlZuMgCu alloys", Metallurgical Transactions, Vol. 4, March, 1973, pp. 857–862, mentions a loss of structural hardening capacity, measured in terms of the density of GP zones, for thin sheets of Al—Zn5.5—Mg2.5—Cu1.6 alloy with an addition of either 0.23% Cr or 0.22% Zr relative to the same alloy without these additions.

This article teaches What zirconium is more effective than chromium in limiting the loss of the hardening power of the alloy during annealing. But even in the presence of zirconium, when the quench rate is 4° C./s, that is the quench rate at the core of a product approximately 200 mm thick immersed in cold water, the loss of hardening power is considerable and the zirconium no longer makes it possible to limit the quench sensitivity. The article also shows that, for the composition tested, even in the absence of chromium or zirconium, a loss of hardening power is observed for a quench rate of the order of 4° C./s.

In order to reduce quench sensitivity, Russian metallurgists have proposed the alloy V93, or 1930 according to the Russian standard GOST 11069, which does not include any antirecrystallant elements, but which has a very different composition from that of the alloys 7010 and 7050, including in particular a high iron content (between 0.20 and 0.45%) which is unfavorable to toughness and fatigue resistance.

The article by H. A. HOLL, "Investigations into the possibility of reducing quench sensitivity in high-strength AlZnMgCu alloys", Journal of the Institute of Metals, July 1969, pp. 200–205, makes the same observation as to the harmful effect of the elements Zr, Mn, Cr and V, that is the antirecrystallants, but also of Fe and Si at commercial purity levels, on the hardenability of thin sheets. This means that in order to reduce the quench sensitivity of these alloys, it is necessary to use compositions with low Fe and Si contents, which increases production costs with respect to alloys of commercial purity. However, the teaching of this article, which relates to thin sheets, cannot be transferred to heavy plates, due to the microstructural differences which result from the different production processes.

Finally, the Applicant performed a measurement of the yield strength $R_{0.2}$ in the L and TL directions on sheets of different thicknesses made from treated alloy 7050 in the T7451 temper intended for the aeronautics industry and observed a loss of about 0.5 MPa per mm of additional thickness. FIGS. 1 and 2 show the statistical distribution of these values for the L direction and the TL direction, respectively. These results match those in the above-mentioned article by DORWARD et al., which shows, in the T6 temper, a loss on the order of 40 MPa between quench rates of 25° C./s and 8° C./s, which approximately corresponds to the cooling speeds in cold water at the core of plates with respective thicknesses of 60 and 150 mm. Thus, the prior art does not indicate, for thick products made from alloys of the 7000 type, any means which make it possible to simultaneously control recrystallization using zirconium to obtain high strength and toughness, and to limit the quench sensitivity so as to obtain homogeneous mechanical properties between the surface and the core of the product and to avoid the loss of mechanical strength in proportion to the thickness of the product, especially when it is desirable to use alloys with Fe and Si of commercial purity.

Moreover, it is known that for alloys of the 7000 type which contain copper, stress corrosion resistance declines when the quench rate decreases, that is, when the thickness increases. Thick products made from alloys of the 7000 type with high copper contents are therefore not a possible solution when seeking good corrosion behavior.

SUMMARY OF THE INVENTION

The object of the invention is to find, for alloys of the 7000 type containing copper with additions of zirconium, a specific range of composition for thick products which renders them not very quench sensitive, in which recrystallization is kept to a low level while the commercial purity of the iron and silicon is retained, and which results in high mechanical strength and toughness as well as good fatigue behavior, without any harmful effect on stress corrosion resistance.

In accordance therewith, the invention is directed to a rolled, extruded or forged AlZnMgCu alloy product >60 mm thick, preferably >125 mm thick, with the following composition (% by weight):

| |
|---|
| 5.7 < Zn < 8.7 |
| 1.7 < Mg < 2.5 (and preferably < 2.3) |
| 1.2 < Cu < 2.2 (and preferably < 2.1) |
| Fe < 0.14 |
| Si < 0.11 |
| 0.05 < Zr < 0.15 |
| Mn < 0.02 |
| Cr < 0.02 |

with Cu+Mg<4.1 (and preferably <4.05)

other elements <0.05 each and <0.10 in total, which product, after shaping, is treated by natural aging, quenching and possibly annealing, and in the T7451 (de-stressed by controlled traction) or T7452 (de-stressed by compression) temper has the following properties:

a) a conventional yield strength at 0.2% of elongation $R_{0.2}$, measured at quarter-thickness in the L and TL directions >400 MPa, b) toughness under plane strain in the S-L direction, measured at half-thickness,>26 MPa$\sqrt{m}$ and in the L-T direction, measured at quarter-thickness, >74−0.08 e−0.07 $R_{0.2L}$ MPa$\sqrt{m}$ (e being the thickness of the product in mm), c) a stress corrosion threshold >240 MPa, and preferably >300 MPa.

Preferably, the products according to the invention have a volume fraction of recrystallized grains, measured in the part disposed between the quarter-thickness and the half-thickness ≦35%. The magnesium content is preferably kept higher than the copper content.

Another subject of the invention is a product made from an alloy with the more limited composition:

5.7<Zn<8.7

1.7<Mg<2.15

1.2<Cu<2.0

Fe<0.14 Si<0.11

0.05<Zr<0.15

Mn<0.02 Cr<0.02 with Mg+Cu<4.0 other elements <0.05 each and <0.10 in total, having the same properties as before, but in which the recrystallization rate has little influence on these properties.

The toughness under plane strain is preferably >28 MPa $\sqrt{m}$ in the S-L direction and >74−0.08 e−0.07 $R_{0.2L}$ MPa$\sqrt{m}$. The latter formula is commonly used in the aeronautics industry. Other objects of the invention are products with the same composition as before which, after an annealing for an equivalent time t(eq) between 600 and 1,000 hours, has the following properties:

a) $R_{0.2}$ at quarter-thickness in the L and TL directions >425 MPa, b) toughness under plane strain in the S-L direction >25 (preferably 28) MPa$\sqrt{m}$ and in the L-T direction >74 (preferably 75)−0.08 e−0.07 $R_{0.2(L)}$ MPa$\sqrt{m}$, c) a stress corrosion threshold >240 MPa (preferably 300 MPa).

When the equivalent time is between 1,000 and 1,600 hours, the properties are the following:

a) $R_{0.2}$ in the L and TL directions >400 MPa, b) toughness under plane strain in the S-L direction >28 MPa$\sqrt{m}$ and in the L-T direction >76 (preferably 77)−0.08 e−0.07 $R_{0.2(L)}$ MPa$\sqrt{m}$ c) a stress corrosion threshold >240 MPa.

The equivalent time t(eq) is defined by the formula:

$$t(eq)=(\int \exp(-16{,}000/T)dt)/\exp(-16{,}000/T_{ref})$$

where T is the instantaneous temperature in ° K during the annealing and $T_{ref}$ is a reference temperature selected at 120° C. (393° K). t(eq) is expressed in hours.

BRIEF DESCRIPTION OF THE DRAWINGS

In the same way.

DESCRIPTION OF THE PREFERRED EMBODIMENTS

Contrary to all expectations, and to the teaching of the above-mentioned article by DORWARD et al. in particular, the inventors determined a composition range for alloys of the 7000 type containing copper and zirconium, with commercial contents of iron and silicon, which makes it possible to control recrystallization and which, beginning at a thickness of about 60 mm, results in a reduction of the quench sensitivity of the product when the thickness of the product increases, while retaining good toughness and good stress corrosion resistance, with a conventional industrial transformation range.

Figure 3:
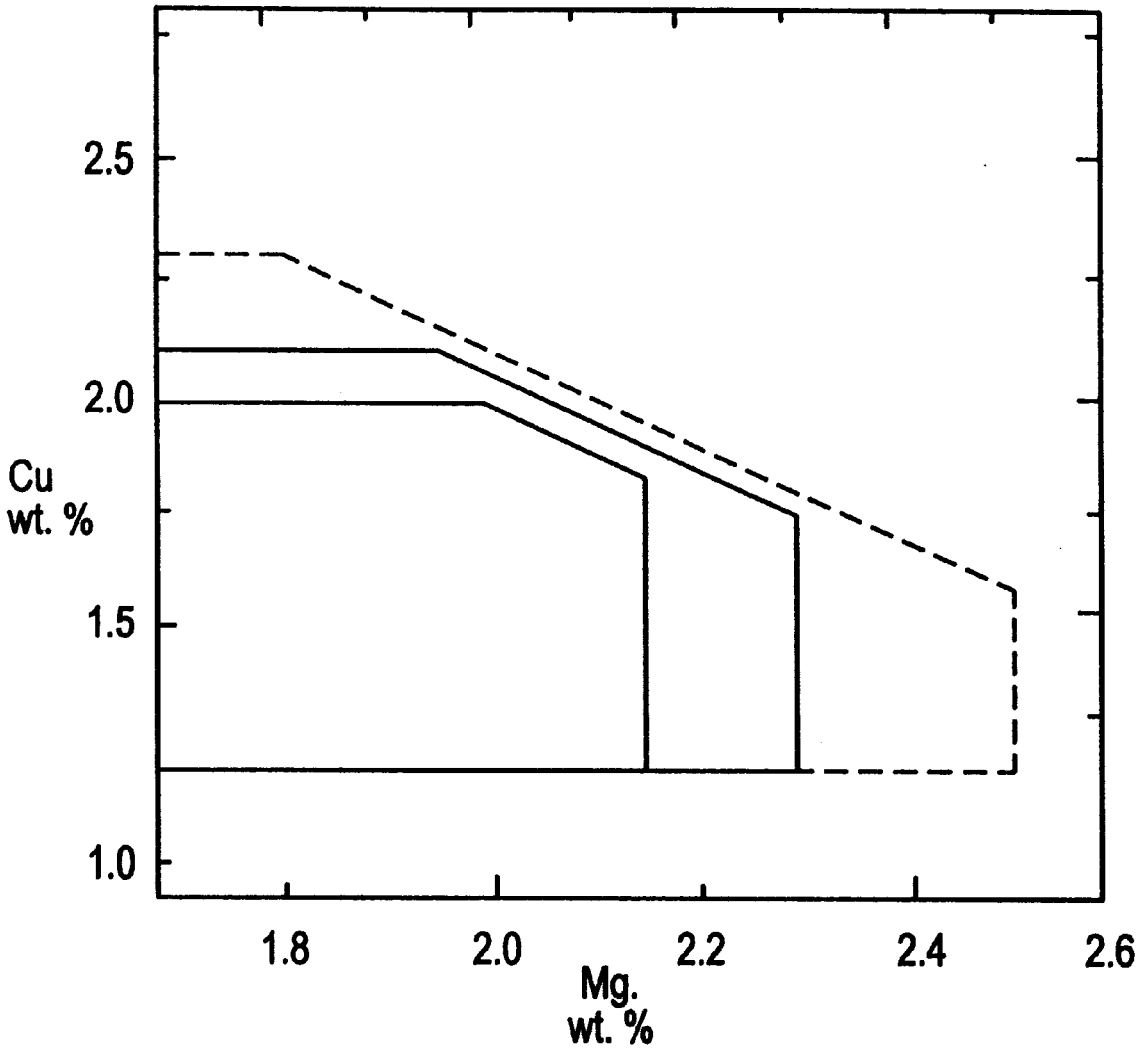
FIG. 3 represents, in an Mg—Cu diagram, the composition range of the invention (in a broken line), as well as the preferred range (in a light solid line), and the limited range (in a bold solid line).

The magnesium content of the alloy is reduced relative to that of the alloys 7010 or 7050, since it is centered around 2% instead of 2.3%, but it is not possible to go below 1.7% and still retain sufficient mechanical properties. The copper is centered around 1.7%, which corresponds to an increase relative to 7010, but a decrease relative to 7050. It is important to maintain a certain equilibrium between Cu and Mg: if Cu+Mg>4.1, the toughness-yield strength compromise is adversely affected, rendering the product insignificant. It can be advantageous to keep the Mg content higher than the Cu content. The composition range according to the invention, as well as the preferred range, is represented in a Mg—Cu diagram in FIG. 3.

Principally, zirconium is used as the antirecrystallant element, while manganese and chromium, which increase quench sensitivity, are avoided as much as possible. The Zr content must exceed 0.05% in order to affect the recrystallization but must remain below 0.15% in order to prevent quench sensitivity and to avoid problems during casting. The iron and silicon contents are equivalent to those in 7010 and 7050.

The process for producing the product according to the invention is similar to that for products made from alloys of the 7000 type, for example 7010 and 7050. It comprises the casting of a plate or a billet, a homogenization at a temperature between 450 and 485° C., a hot transformation in one or more stages by rolling, extrusion or forging at a temperature between 370 and 460° C. which is controlled so as to obtain the desired recrystallization rate, a quenching by immersion in or spraying with cold water or at a temperature lower than 95° C., a de-stressing by deformation at the ambient temperature (controlled traction or compression), at a rate of less than 5%, and possibly an aging treatment to obtain, for example, the tempers T6, T74, T76, T751, T7451 or T7651, particularly in the case of the utilization of these products for molds for plastics.

EXAMPLES

Example 1

Nine plates were cast, 3 of the standard alloy 7050, 3 with an alloy designated F according to the invention and 3 with an alloy X according to the invention, with the following composition (% by weight):

| | Zn | Mg | Cu | Si | Fe | Zr |
|---|---|---|---|---|---|---|
| alloy 7050 | 6.1 | 2.35 | 2.20 | 0.05 | 0.09 | 0.10 |
| alloy F | 6.1 | 2.25 | 1.68 | 0.05 | 0.09 | 0.10 |
| alloy X | 6.4 | 2.0 | 1.29 | 0.05 | 0.10 | 0.11 |

The nine plates were then scalped and homogenized to 475° C. (7050) and 465° C. (alloys F and X), respectively, and one plate of each alloy was rolled to a thickness of 130 mm, another to 150 mm, and the third to 200 mm. The inlet temperatures of the rolling were between 410 and 420° C. for the three alloys. The outlet temperatures of the rolling were between 425 and 440° C. All 9 plates were solution heat treated to 480° C., quenched by immersion in cold water and stretched with a deformation rate on the order of 2%. The plates were then subjected to a two-stage aging:

6 h at 120° C. and 17 h at 165° C. for the plates made of alloy 7050, 6 h at 115° C. and 10 h at 172° C. for the plates made of alloys F and X.

The conventional yield strength $R_{0.2}$ (in MPa) of each of these plates in the L and TL directions was measured at quarter thickness, as was the toughness $K_{1c}$ (in MPa$\sqrt{m}$) in the L-T direction, in accordance with the ASTM E399 standard for CT test pieces. The results are indicated in Table 1, where the toughness is compared to the value (74−0.08 e−0.07 $R_{0.2(L)}$) MPa$\sqrt{m}$, in which e designates the thickness of the plate in mm. This expression makes it possible, for thick products made from AlZnMgCu alloys with compositions similar to those of the known alloys 7010 and 7050 and from the alloys according to the invention, to compare products with different thicknesses and/or different static mechanical properties.

Figure 1:
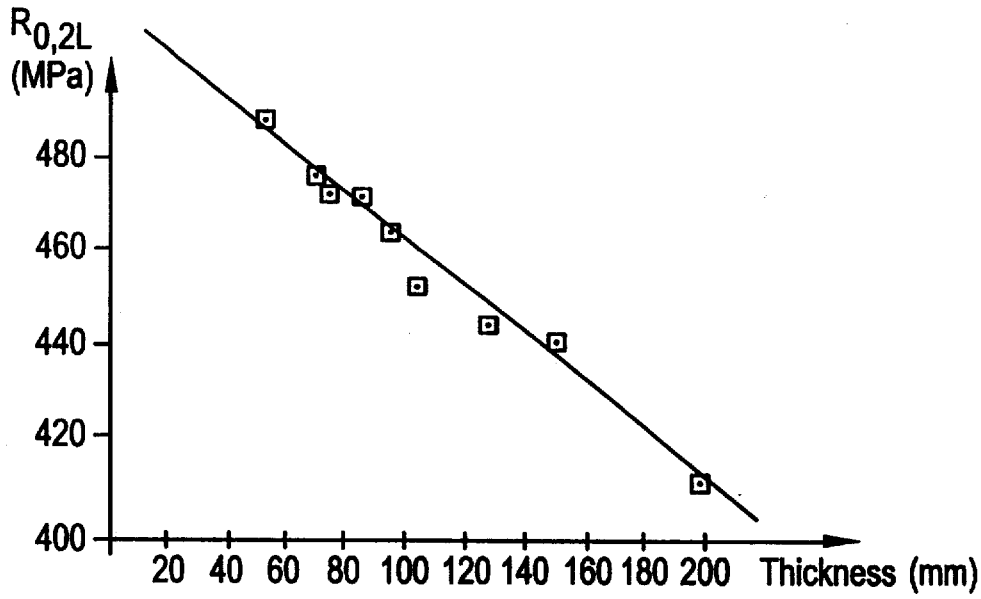
FIG. 1 represents the yield strength at 0.2% $R_{0.2}$ in the L direction, as a function of thickness, of a set of sheets made of alloy 7050 in the T7451 temper according to the prior art.
Figure 2:
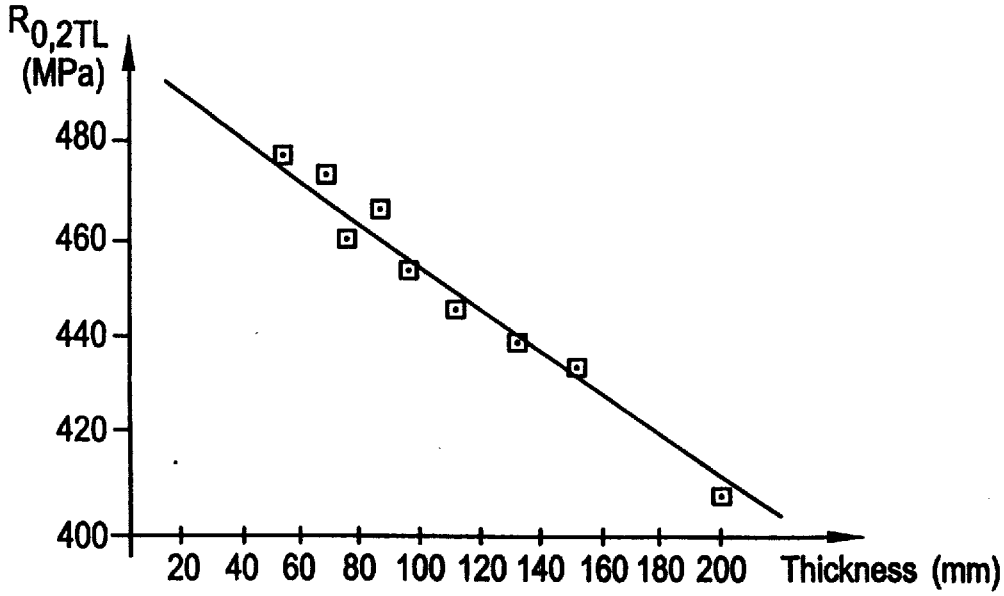
FIG. 2 represents $R_{0.2}$ in the TL direction, as a function of thickness, of the same set of sheets.

It is noted that plates made from the alloy according to the invention have a total absence of quench sensitivity when the thickness increases, which is not the case with the plates made from standard 7050, as will be seen in FIGS. 1 and 2. Thus, although the Mg and Cu contents are lower, an equal or greater level of mechanical strength is unexpectedly obtained for these thickness. Substantially better toughness is also observed.

TABLE 1

| | Thickness [mm] | $R_{0.2(L)}$ at 1/4 th. [MPa] | $R_{0.2(TL)}$ at 1/4 th. [MPa] | $K_{1c(LT)}$ at 1/4 th. [MPa$\sqrt{m}$] | 74-0.08e-0.07$R_{0.2(L)}$ [MPa$\sqrt{m}$] |
|---|---|---|---|---|---|
| alloy 7050 | 130 | 450 | 445 | 29.6 | 32.1 |
| | 150 | 443 | 442 | 28.4 | 31.0 |
| | 200 | 415 | 410 | 24.0 | 29.0 |
| alloy F (invention) | 130 | 445 | 440 | 37.5 | 32.5 |
| | 150 | 443 | 442 | 35.8 | 31.0 |
| | 200 | 448 | 438 | 32.6 | 26.6 |
| alloy X (invention) | 130 | 445 | 444 | 36.8 | 32.1 |
| | 150 | 443 | 440 | 36.1 | 31.0 |
| | 200 | 441 | 436 | 33.0 | 27.1 |

Example 2

Two alloys were cast, the first of which had a composition according to the invention (alloy G), the second of which was a standard alloy 7050. The compositions of these alloys are shown in Table 2.

The cast plates were homogenized at around 470° C. and rolled in three passes to a thickness of 6 inches (152 mm), 7.5 inches (190 mm), or 8 inches (203 mm), as indicated in Table 3. The outlet temperatures of the rolling are also indicated in Table 3. The plates were solution heat treated at 480° C., quenched by immersion in cold water, and subjected to a controlled traction with a deformation rate of 2%. The plates were then subjected to a two-stage aging:

6 h at 115° C. and 10 h at 172° C. for the plates of alloy G (according to the invention), 6 h at 120° C. and 17 h at 165° C. for the plates of alloy 7050 (prior art).

For each alloy-thickness combination, the yield strength $R_{0.2}$ was measured at quarter-thickness in the L and TL directions, and the toughness $K_{1c}$ was measured in the L-T direction (at quarter-thickness), the T-L direction (at quarter-thickness) and the S-L direction (at half-thickness), in accordance with the ASTM E399 standard. The recrystallization rate of each plate was also measured at quarter-thickness and at half-thickness. This measurement was performed on treated samples in the T351 temper, treated for 6 hours at 160° C., and then polished and attacked by a solution containing 84 parts chromium solution, 15 parts nitrogen solution, and 1 part fluoride solution at the ambient temperature for about ½ hour. The recrystallization rate was measured by image analysis on micrographs of these samples, in which the recrystallized grains appeared light against the dark non-recrystallized matrix. All of the results are indicated in Table 3.

It is noted that the plates according to the invention have a yield strength similar to or greater than that of 7050 with a higher toughness level, particularly in the L-T direction. In fact, the L-T toughness of the plate of alloy 7050 is less than 31.4 MPa$\sqrt{m}$ for a thickness of 152 mm, or 28.1 for a thickness of 190 mm, that is, less than the values corresponding to 74–0.083–0.07 $R_{0.2L}$.

Moreover, in the plates according to the invention, tensile strength levels in the TC direction >300 MPa were measured after 30 days in a 3.5% NaCl solution, with immersion-emersion cycles of 10 and 50 min., in accordance with the ASTM G 44–75 standard relative to the measurement of stress corrosion resistance.

TABLE 2

| | Zn(%) | Mg(%) | Cu(%) | Fe(%) | Si(%) | Zr(%) |
|---|---|---|---|---|---|---|
| alloy G (invention) | 6.01 | 2.26 | 1.62 | 0.09 | 0.04 | 0.11 |
| alloy 7050 | 6.01 | 2.28 | 2.22 | | | |

TABLE 3

| Alloy No. | Th. mm | Outlet temp. ° C. | $R_{0.2(L)}$ at ¼ th. MPa | $R_{0.2(TL)}$ at ¼ th. MPa | $K_{1c(LT)}$ at ¼ th. MPa$\sqrt{m}$ | $K_{1c(TL)}$ at ¼ th. MPa$\sqrt{m}$ | $K_{1c(SL)}$ at ½ th. MPa$\sqrt{m}$ | Recr. rate at ¼ th. % | 74 - 0.08e- 0.07 $R_{0.2(L)}$ MPa$\sqrt{m}$ |
|---|---|---|---|---|---|---|---|---|---|
| G | 203 | 429 | 441 | 437 | 33.5 | 26.4 | 29.0 | 4 | 26.9 |
| G | 152 | 425 | 440 | 435 | 33.7 | 27.4 | 29.1 | 6 | 31.0 |
| 7050 | 152 | 427 | 435 | 431 | 28.4 | 24.8 | 27.1 | 42 | 31.4 |
| 7050 | 190 | 435 | 439 | 421 | 26.8 | 24.2 | 26.9 | 38 | 28.1 |

Example 3

Five types of alloys were cast, the compositions of which are shown in Table 4. The alloy A is a standard 7050, the alloy B is a 7050 optimized with a low MG content. The alloys C, D and E have compositions according to the invention. The cast plates were homogenized at around 470° C. and hot rolled to thicknesses of 8 inches (203 mm), or 8.5 inches (215 mm). The plates were then solution heat treated at 480° C., quenched by immersion in cold water, and subjected to a controlled traction with a deformation rate of 2%. The plates were then subjected to a standard two-stage aging with a first stage between 115° C. and 120° C., and a second stage around 170° C., this two-stage treatment being characterized by an equivalent time t(eq) between 950 hours and 1,580 hours, expressed by the equation:

$$t(eq) = \frac{\int \exp(-16{,}000/T)dt}{\exp(-16{,}000/T_{ref})}$$

in which T (in Kelvin) indicates the temperature of the heat treatment which continues for a time t (in hours), and $T_{ref}$ is a reference temperature, here set at 393 K or 120° C.

For each alloy-thickness combination, the yield strength $R_{0.2}$ in the L direction was measured at quarter-thickness and the toughness $K_{1c}$ was measured at quarter-thickness in the L-T direction in accordance with the ASTM E399 standard. The recrystallization rate of each plate was also measured using the method described in Example 2. All of the results are shown in Table 4. The type A and B alloys correspond to the prior art, and the type C, D and E alloys correspond to the invention. For all of these alloys, the stress corrosion threshold was higher than 300 MPa.

TABLE 4

| Alloy | Mg % | Zn % | Cu % | Thickness mm | Recr. rate at 1/4 th. % | $R_{0.2(L)}$ at 1/4 th. MPa | $K_{1c(LT)}$ at 1/4 th. MPa$\sqrt{m}$ | 74-0.08e-0.07 $R_{02(L)}$ MPa$\sqrt{m}$ |
|---|---|---|---|---|---|---|---|---|
| A | 2.42 | 6.0 | 2.29 | 215 | <10 | 418 | 24.6 | 27.5 |
| A | 2.42 | 6.0 | 2.29 | 215 | <10 | 420 | 23.4 | 27.4 |
| A | 2.42 | 6.0 | 2.29 | 215 | <10 | 432 | 25.7 | 26.6 |
| A | 2.42 | 6.0 | 2.29 | 215 | <10 | 430 | 25.7 | 26.7 |
| B | 2.07 | 6.4 | 2.15 | 203 | 20 | 417 | 27.2 | 28.6 |
| C | 2.22 | 6.0 | 1.84 | 215 | | 444 | 29.9 | 25.7 |
| C | 2.22 | 6.0 | 1.84 | 215 | | 440 | 29.3 | 26.0 |
| C | 2.22 | 6.0 | 1.84 | 215 | <10 | 441 | 31.6 | 25.9 |
| C' | 2.21 | 6.0 | 1.83 | 215 | <10 | 432 | 30.3 | 26.6 |

TABLE 4-continued

| Alloy | Mg % | Zn % | Cu % | Thick-ness mm | Recr. rate at 1/4 th. % | $R_{0.2(L)}$ at 1/4 th. MPa | $K_{1c(LT)}$ at 1/4 th. MPa$\sqrt{m}$ | 74-0.08e-0.07 $R_{02(L)}$ MPa$\sqrt{m}$ |
|---|---|---|---|---|---|---|---|---|
| C | 2.22 | 6.0 | 1.84 | 215 | <10 | 419 | 30.3 | 27.5 |
| D | 2.25 | 6.0 | 1.60 | 203 | <10 | 444 | 30.9 | 26.7 |
| D | 2.25 | 6.0 | 1.60 | 203 | <10 | 432 | 32.8 | 27.5 |
| D' | 2.32 | 6.1 | 1.68 | 215 | <10 | 416 | 32.9 | 27.7 |
| E | 2.08 | 6.4 | 1.69 | 215 | <10 | 465 | 35.6 | 24.3 |

It is noted that or the alloys A and B, the value Of $K_{1c(LT)}$ measured at quarter-thickness is always lower than the reference value 74–0.08 e–0.07 $R_{0.2(L)}$, whereas for the alloys according to the invention, it is always significantly higher. This indicates that the compromise between static mechanical properties and toughness is better.

Example 4

Three type E alloys were cast, whose compositions are shown in Table 5. The alloys were transformed according to the process in Example 3, and subjected to the same types of tests. The results are shown in Table 5.

TABLE 5

| Alloy | Mg % | Zn % | Cu % | Thick-ness mm | Recry. rate at 1/4 th. % | $R_{0.2(L)}$ at 1/4 th. MPa | $K_{1c(LT)}$ at 1/4 th. MPa$\sqrt{m}$ | 74 - 0.08e - 0.07 $R_{0.2(L)}$ MPa$\sqrt{m}$ |
|---|---|---|---|---|---|---|---|---|
| E | 2.08 | 6.4 | 1.69 | 215 | <10 | 465 | 35.6 | 24.3 |
| E' | 2.01 | 6.4 | 1.62 | 215 | 25 | 460 | 32.0 | 24.6 |
| E" | 1.99 | 6.4 | 1.66 | 215 | 70 | 442 | 29.0 | 25.9 |

It is noted that for the limited composition range chosen, the recrystallization rate had only a limited influence on the toughness—yield strength compromise, insofar as the value of $K_{1c(LT)}$ measured at quarter thickness is always sharply higher than the reference value 74–0.08 e–0.07 $R_{0.2(L)}$.

Example 5

Four types of alloys were cast, the compositions of which are shown in Table 6. The type E alloys correspond to the invention, and the type B alloy corresponds to the prior art. All the alloys were transformed according to the process in Example 3. The thickness of the plates was 215 mm. However, the influence of the equivalent time of the second aging stage was examined. The plates were subjected to the same types of tests. The results are shown in Table 6.

TABLE 6

| Alloy | Mg % | Zn % | Cu % | Recry. Rate at 1/4 th. % | t(eq) hours | $R_{0.2(L)}$ at 1/4 th. MPa | $K_{1c(LT)}$ at 1/4 th. MPa$\sqrt{m}$ | 74 - 0.08e-0.07 $R_{0.2(L)}$ MPa$\sqrt{m}$ |
|---|---|---|---|---|---|---|---|---|
| E | 1.99 | 6.4 | 1.66 | 60 | 989 | 442 | 29.0 | 25.9 |
| E" | 1.99 | 6.4 | 1.66 | 60 | 1186 | 431 | 28.7 | 26.6 |
| E" | 1.99 | 6.4 | 1.66 | 60 | 1383 | 408 | 30.2 | 28.2 |
| E | 2.08 | 6.4 | 1.69 | <10 | 661 | 477 | 33.9 | 23.2 |
| E | 2.08 | 6.4 | 1.69 | <10 | 858 | 465 | 35.6 | 24.2 |
| E' | 2.01 | 6.4 | 1.62 | 30 | 661 | 479 | 29.7 | 23.2 |
| E' | 2.01 | 6.4 | 1.62 | 30 | 858 | 459 | 32.0 | 24.6 |
| E' | 2.01 | 6.4 | 1.62 | 30 | 1055 | 448 | 32.5 | 25.4 |
| B | 2.13 | 6.0 | 2.10 | 15 | 1120 | 429 | 26.6 | 27.7 |
| B | 2.13 | 6.0 | 2.10 | 15 | 1383 | 417 | 27.2 | 28.6 |
| B | 2.13 | 6.0 | 2.10 | 15 | 1645 | 411 | 27.9 | 29.0 |

It is noted that for the products according to the invention, for the limited composition range chosen, the conditions of the aging have little influence on the compromise between toughness and yield strength, insofar as the value of $K_{1c(LT)}$ measured at quarter-thickness is always sharply higher than the reference value 74–0.08 e–0.07 $R_{0.2(L)}$. On the other hand, the products according to the prior art are characterized by a $K_{1c(LT)}$ value which is always sharply lower than the reference value.

Example 6

Two type D alloys were cast, the compositions of which are shown in Table 7 (the zinc content for both alloys was 6.0%). The alloys were transformed according to the process in Example 3. The plates were subjected to the same types of tests. The results are shown in Table 7.

TABLE 7

| Al-loy | Mg % | Cu % | Zr % | th. mm | Recr Rate at 1/4 th. % | Recr Rate at 1/2 th. % | $R_{0.2(L)}$ at 1/4 th. MPa | $R_{0.2(TL)}$ at 1/4 th. MPa | $K_{1c(LT)}$ at 1/4 th. MPa$\sqrt{m}$ | $K_{1c(SL)}$ at 1/2 th. MPa$\sqrt{m}$ | 74 - 0.08e - 0.07 $R_{0.2(L)}$ MPa$\sqrt{m}$ |
|---|---|---|---|---|---|---|---|---|---|---|---|
| D | 2.25 | 1.60 | 0.12 | 203 | 5 | 17 | 431 | 431 | 32.8 | 29.5 | 27.5 |
| D | 2.25 | 1.60 | 0.12 | 153 | 4 | 8 | 433 | 431 | 33.8 | 29.7 | 31.5 |

TABLE 7-continued

| Alloy | Mg % | Cu % | Zr % | th. mm | Recr Rate at 1/4 th. % | Recr Rate at 1/2 th. % | $R_{0.2(L)}$ at 1/4 th. MPa | $R_{0.2(TL)}$ at 1/4 th. MPa | $K_{1c(LT)}$ at 1/4 th. MPa√m | $K_{1c(SL)}$ at 1/2 th. MPa√m | 74 - 0.08e - 0.07 $R_{0.2(L)}$ MPa√m |
|---|---|---|---|---|---|---|---|---|---|---|---|
| D" | 2.28 | 1.65 | 0.11 | 203 | 40 | 30 | 459 | 445 | 25.4 | 26.1 | 25.6 |
| D" | 2.28 | 1.65 | 0.11 | 152 | 44 | 35 | 447 | 441 | 28.5 | 25.0 | 30.5 |

It is noted that for the composition range chosen, recrystallization is critical in order to obtain an acceptable compromise between toughness and yield strength. More specifically, the value of the recrystallization rate must not exceed about 35% between quarter-thickness and half-thickness in order to ensure that: the value of $K_{1c(LT)}$ measured at quarter-thickness is aways higher than the reference value 74–0.08 e–0.07 $R_{0.2(L)}$.

Example 7

Four ingots were cast, 2 in alloy Y according to the invention, and 2 in alloy Z, with a composition outside the range of the invention. The compositions (weight %) are given in the table below:

| | Mg | Zn | Cu | Fe | Si | Zr |
|---|---|---|---|---|---|---|
| alloy Y | 2.15 | 8.46 | 1.55 | 0.07 | 0.04 | 0.1 |
| alloy Z | 2.32 | 8.68 | 1.9 | 0.07 | 0.04 | 0.11 |

The 4 ingots were scalped, homogenized at 470° C., and hot rolled to thicknesses of 100 or 150 mm (one plate at each thickness for each alloy). Rolling commenced at between 410 and 415° C. and finished at between 430 and 440° C. The 4 plates were solution heat treated at 475° C., quenched by immersion in cold water and stress-relieved using a stretch of around 2%. The plates were then given a two-step aging treatment (T7651 temper) of 24 hours at 120° C.+12 hours at 160° C.

For each plate, at the quarter-thickness position (¼t) the 0.2% offset yield strength $R_{0.2}$ was measured in the long (L) and transverse (LT) directions, and the plane strain fracture toughness $K_{1c}$ was measured in the L-T direction, following the ASTM E399 standard using CT samples. The recrystallized volume fraction was also measured by image analysis at quarter-thickness. The results are shown in Table 8. The toughness (mPa√m) should be compared with the quantity 74–0.08 t–0.07 $R_{0.2}$ (MPa√m) where t is the plate thickness in mm (as in example 1). It can be seen that alloy Y (the invention) gives superior strength and toughness compared with alloy Z.

The stress-corrosion resistance of the alloy Y (invention) plates in the short transverse direction was measured following the ASTM G44–75 standard. No samples failed within 20 days exposure at stresses less than or equal to 240 MPa.

TABLE 8

| | Plate thickness t (mm) | Recrystallization 1/4t (vol %) | $R_{0.2}$ (L) 1/4t (MPa) | $R_{0.2}$ (LT) 1/4t (MPa) | $K_{1c}$ L-T 1/4t (mPa√m) | 74-0.08t-0.07$R_{0.2}$ (L) |
|---|---|---|---|---|---|---|
| alloy | 100 | 18 | 525 | 522 | 30.2 | 29.3 |
| Y | 150 | 17 | 490 | 471 | 28.1 | 27.7 |
| alloy | 100 | 14 | 523 | 513 | 25.9 | 29.4 |
| Z | 150 | 10 | 477 | 458 | 26.3 | 28.6 |

What is claimed is:

1. A mold for plastics comprising a rolled, extruded or forged AlZnMgCu aluminum alloy product >60 mm thick, and having a composition which comprises, in weight %:

| |
|---|
| 5.7 < Zn < 8.7 |
| 1.7 < Mg < 2.5 |
| 1.2 < Cu < 2.2 |
| Fe < 0.14 |
| Si < 0.11 |
| 0.05 < Zr < 0.15 |
| Mn < 0.02 |
| Cr < 0.02 |

with Cu+Mg<4.1 and Mg>Cu, other elements <0.05 each and <0.10 in total, the product having been treated by solution heat treating, quenching and aging to a T6 temper.

2. The mold according to claim 1, in which 1.7<Mg<2.3.

3. The mold according to claim 1, in which 1.2<Cu<2.1.

4. The mold according to claim 1, wherein between quarter-thickness and half-thickness, the alloy product has a volume fraction of recrystallized grains <35%.

5. The mold according to claim 1, wherein the alloy product is in a T651 or T652 temper.

* * * * *